US005369256A

United States Patent [19]

Woods

[11] Patent Number: 5,369,256

[45] Date of Patent: Nov. 29, 1994

[54] PACKAGING CAPABLE OF MICROWAVE HEATING

[75] Inventor: Kenneth D. Woods, Manchester, England

[73] Assignee: Waddingtons Cartons Limited, Leeds, England

[21] Appl. No.: 979,761

[22] Filed: Nov. 20, 1992

[30] Foreign Application Priority Data

Apr. 3, 1992 [GB] United Kingdom ..... 9207318.8

[51] Int. Cl.[5] ..... H05B 6/80

[52] U.S. Cl. ..... 219/727; 219/730; 219/734; 426/234; 426/107; 229/903; 99/DIG. 14

[58] Field of Search ..... 219/10.55 E, 10.55 F, 219/730, 727, 734, 735, 732; 99/DIG. 14; 426/107, 110, 111, 113, 234, 243; 229/9, 10, 19, 20, 902, 903, 904

[56] References Cited

U.S. PATENT DOCUMENTS

| | | | |
|---|---|---|---|
| 3,865,301 | 2/1975 | Pothier et al. | 426/107 |
| 4,280,651 | 7/1981 | Montealegre et al. | 229/20 |
| 4,286,136 | 8/1981 | Mason, Jr. | 219/10.55 E |
| 4,567,341 | 1/1986 | Brown | 219/10.55 F |
| 4,592,914 | 6/1986 | Kuchenbecker | 426/107 |
| 4,836,438 | 6/1989 | Rigby | 229/52 B |
| 4,866,232 | 9/1989 | Stone | 219/10.55 E |
| 5,045,330 | 9/1991 | Pawlowski | 219/10.55 E |
| 5,049,710 | 9/1991 | Prosise et al. | 219/10.55 E |
| 5,227,599 | 7/1993 | Mason et al. | 219/10.55 E |

FOREIGN PATENT DOCUMENTS

| | | |
|---|---|---|
| 0336325 | 10/1989 | European Pat. Off. . |
| 2046060 | 3/1980 | United Kingdom . |
| 2232556 | 12/1990 | United Kingdom . |
| WO90/15514 | 12/1990 | WIPO . |
| WO92/03358 | 3/1992 | WIPO . |

*Primary Examiner*—Philip H. Leung
*Attorney, Agent, or Firm*—Klauber & Jackson

[57] ABSTRACT

A packaging container for use in connection with microwave cooking of foodstuffs is provided. The container can be opened up so as to define an extended base area, allowing foodstuffs comprising individual items to be spread out during cooking. The extension is achieved by utilization of container portions not originally part of the base. The extended base area preferably is covered with microwave susceptible material.

8 Claims, 4 Drawing Sheets

PACKAGING CAPABLE OF MICROWAVE HEATING

This invention relates to packaging containers which are of a type for use in connection with the cooking by microwave of foodstuffs held by the containers.

The invention has particular application to foodstuffs which are to be cooked in the packaging container by means of microwave energy. The foodstuffs in question are also of a nature in that they comprise a number of individual items such as chipped potatoes or products which are known as chicken nuggets or the like wherein in each packaging container there will be a number of the foodstuff items or perhaps a foodstuff which can be spread out such as mashed potato, as opposed for example to a single portion of foodstuffs such as a chicken burger which is of fixed dimension.

In the packaging and microwave cooking in the packaging of these products a number of conflicting requirements arise. Firstly, it is desirable that the individual items should be packaged in the container in as smaller volume as possible so that there will be maximum utilisation of space during transportation, storage and display on shelves. However, when it comes to the effective microwave cooking of these products, it is desirable that the products should be eased or shaken apart or spread out so as to allow the microwaves to pass between and over the products and effectively cook all of the products more evenly. One requirement therefore suggests small packaging, whilst the other requirement suggests that larger packaging is required.

In the case of many foodstuff products which are in a number of items or can be spread out, it is often the case that the user will remove the item/items from the packaging and cook it/them on a separate piece of domestic holloware such as plate or bowl, which can be inconvenient.

This is not normally possible where the products are of a nature requiring the application of a more intense radiation type heat to provide browning or crisping, especially in the case of chipped potatoes, because in such arrangement, the packaging is usually provided with a layer of a receptor or susceptor material which is of a nature which heats up intensely under the influence of the microwaves and provides almost a grilling or frying surface for the products. Examples of receptor material and receptor material packages are disclosed in United Kingdom Patent No 2 046 060.

The present invention is concerned with providing packaging for use in connection with microwave cooking of products of the nature described, and also to a combination of packaging and product, whereby the aforesaid disadvantages may be obviated or mitigated.

In accordance with the present invention in a first aspect, packaging containing products for microwave cooking, by cooking the products in the packaging, comprises a container of cut and creased sheet material which has a base area of a first and smaller size on which the packaging rests for transportation, storage and display, but which can be opened up so as to define an extended base area larger than said first base area on which the product can stand during microwave cooking, and wherein that extended base area is surrounded by wall means preventing displacement of the product therefrom, but because of the extended base area allowing the product to be more spread out for more effective cooking, and wherein the extended base area overlaps or embraces or is separate from the first base area.

Preferably, in a particular example, the extended base area is covered with microwave receptor or susceptor material. This susceptor or receptor material may lie between the product and a substrate forming part of the cut and creased sheet material of the container, or it may lie to the outside of such substrate as long as the receptor effect is applied from the receptor sheet material to the product.

Preferably, the packaging container in the closed condition is a rectilinear box of rectangular first base area. The extended base area may comprise the first base area plus the area of a wall portion which forms a side in the closed container, but which folds down to form part of the base in the opened container.

Alternatively, the extended base area may comprise a side panel which forms a side in the closed container, and which together with a top of the container forms the extended base area. In the latter case, the container when opened needs to be turned on its side so that the first base area for example lies vertically, and the extended base area can receive the product from the first base area. As the product is displaced from the first base area to the extended base area, the individual items can be spread apart to enhance microwave cooking.

Although it is preferred that in each of the above embodiments, the container in being moved between the closed and open positions ends up with the top of the container lying at right angles to the first base area, and walls on the top and base being continuous, in another arrangement, the container may be adapted to opened out so that the top and first base area lie in the same plane which would be horizontal in the cooking position, and the side wall arrangement would be such that in such opened out position, the side wall would be continuous around the container.

In yet another embodiment, the box is in two slidably interfitting parts which are closest together under storage or display conditions and are pulled apart in the extended base ( or cooking ) condition.

Specific forms of container according to or for use in the present invention will now be described, by way of example, with reference to the accompanying drawings, wherein.

Figure 1:
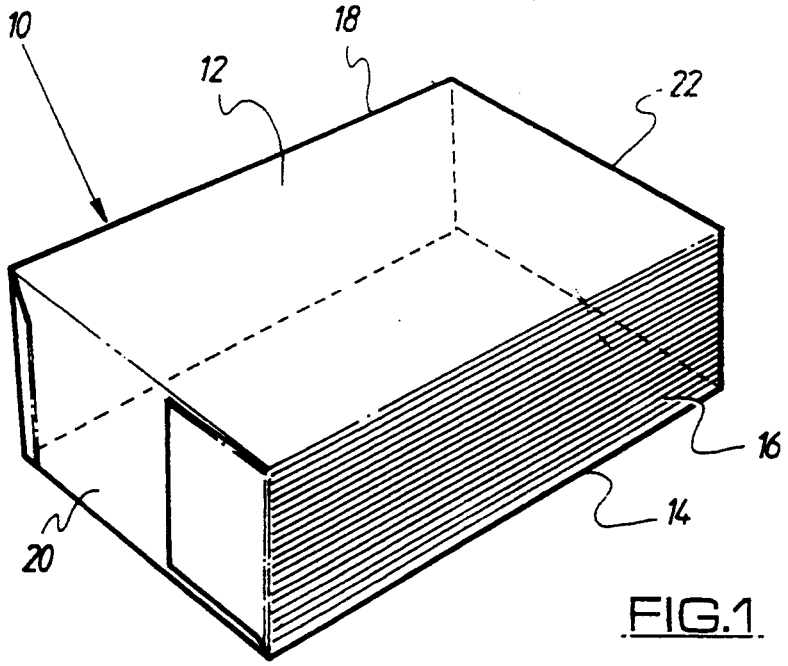
FIG. 1 is a perspective view of a container for use in microwave cooking.
Figure 4:
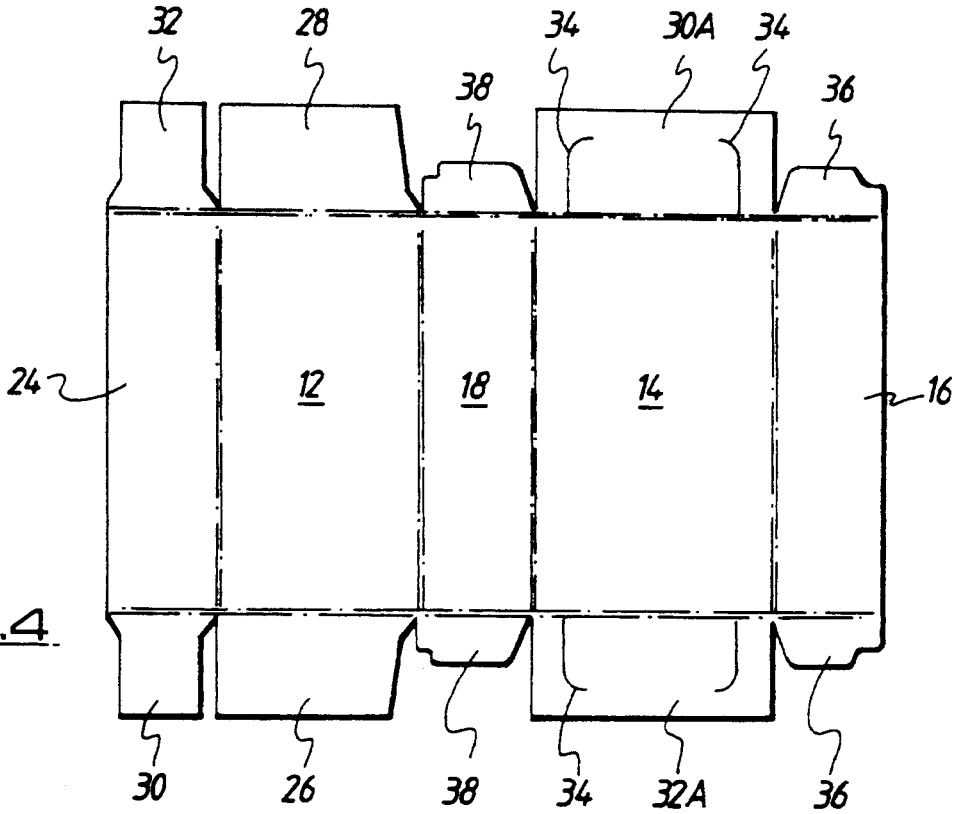
FIG. 4 shows a blank erectible into the container shown in FIG. 1.

Referring to the drawings, and firstly to FIG. 1 a rectilinear box container 10 of the configuration shown is manufactured from a cut and creased sheet material blank such as the blank shown in FIG. 4. The sheet material preferably will be cardboard, but other sheet materials can of course be used. The blank configuration may be any suitable and that given in FIG. 4 is only one example.

Reverting to FIG. 1, the container comprises a top 12, a base 14, front and rear walls 16, 18 and side walls 20 and 22.

Figure 2:
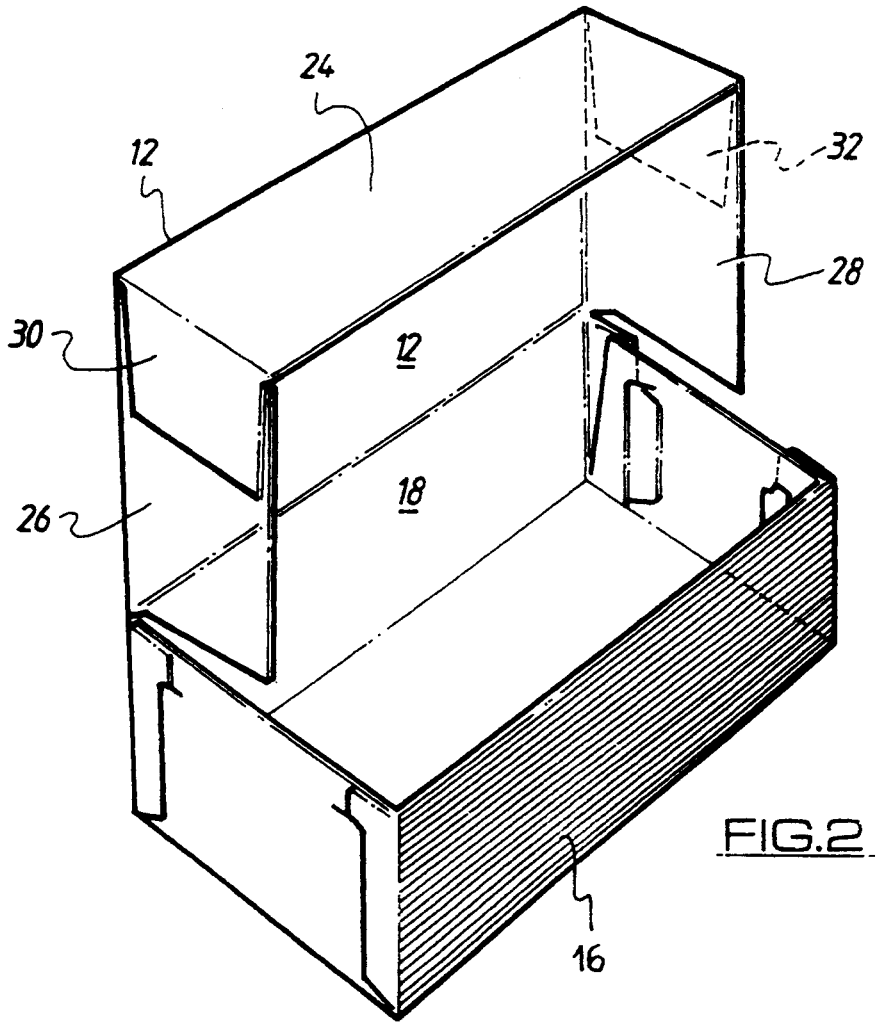
FIG. 2 shows the container of FIG. 1 in the opened condition.

The base 14 has a base area as indicated and referred to as the first base area, and the container is designed so that the top 12 can be opened as shown in FIG. 2.

Figure 3:
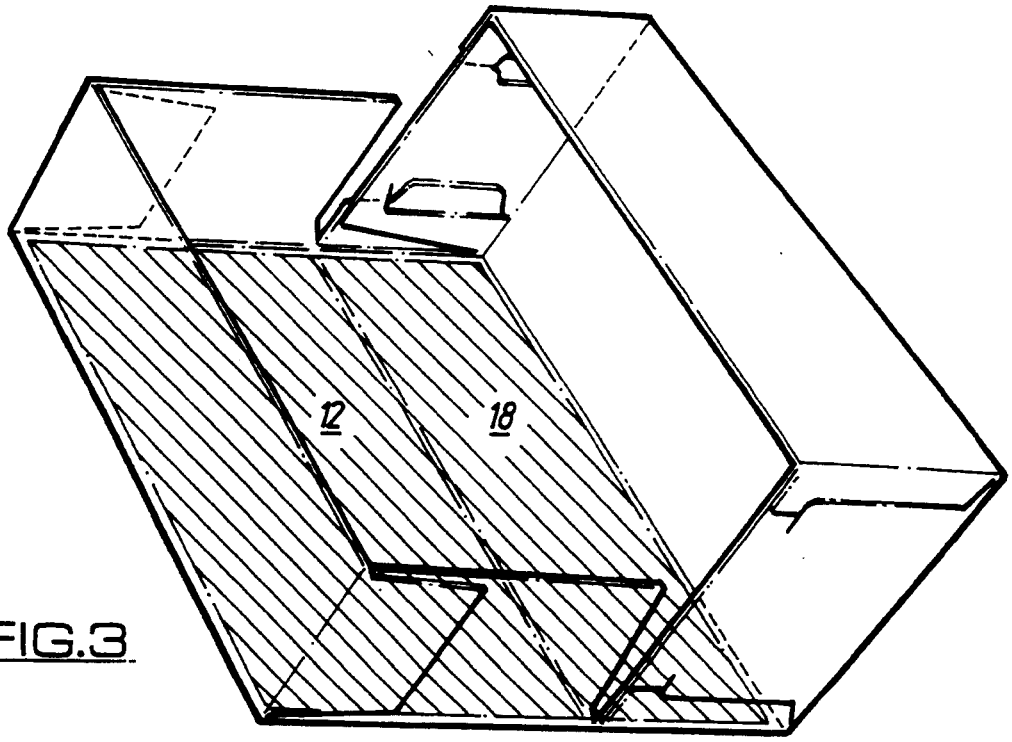
FIG. 3 shows the container of FIG. 2 when positioned for microwave cooking of the container contents.

As can be seen from FIG. 2, the top 12 is provided with a peripheral wall made up of a front wall section 24, side wall sections 26, 28 and glue flaps 30 and 32 which are hinged to section 24 but are glued to sections 26 and 28. When the container is in the position shown in FIG. 2, the top 12 is in the same plane as the rear panel 18 and the rear panel 18 and the top 12 form an extended base surface area which is greater than the surface area of base 14, and in the use of the package, when the container is in the opened position as shown in FIG. 2, it is turned on its side so that the extended base surface as shown in FIG. 3 becomes the actual base surface and the product is tipped from base 14 onto the extended base 12/18. This means that the product can be spread out and can be more effectively microwaved.

The cross hatching shown in FIG. 3 indicates that the extended base surface can if desired be provided overall with receptor material to enhance the microwave cooking. This would be particular appropriate if the product were chipped potatoes.

FIG. 4 is included to show the basic blank which is used for constructing the package shown in FIGS. 1, 2 and 3, and the blank comprises basically two major rectangular panels 12 and 14 connected by the rear panel 18 and wall section 24 is hinged to panel 12, whilst front panel 16 is hinged to panel 14.

The side wall for the base panel 14 is made up of end flaps 30A, 32A provided with lock slots 34 and panel 16 is provided with end locking tabs 36 which engage as shown in FIG. 2 in the locking slots 34 in conventional manner.

Rear panel 18 is provided with similar locking tabs 38 which engage in the slots 34 as also shown in FIG. 2.

The wall portion 24 is shown as having the glue tabs 30 and 32 hinged thereto.

In FIG. 4 the convention adopted is that the full lines show the cut lines of the blank, whilst the double chain dotted lines show the fold lines.

Construction of the container from the blank shown in FIG. 4 will be readily understood by those skilled in the art.

Figure 5:
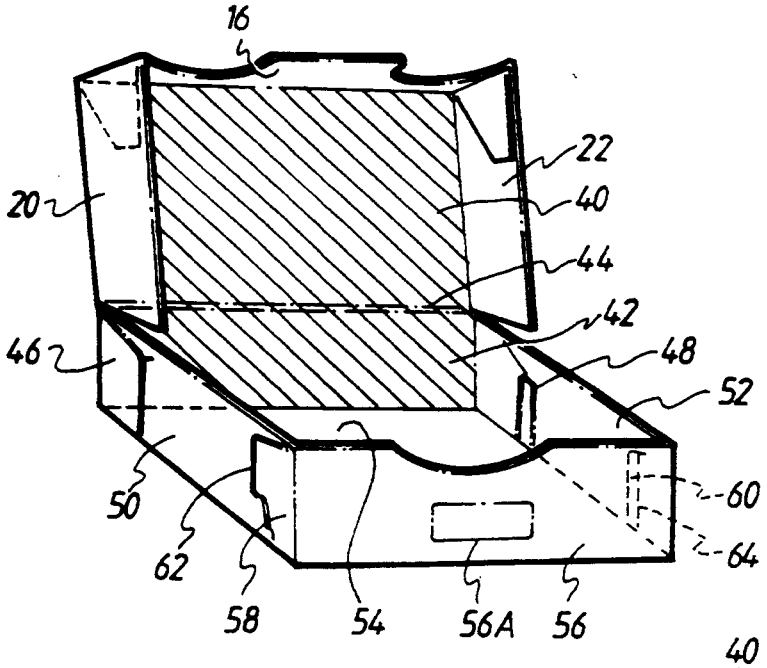
FIG. 5 shows the container in the opened condition and according to another embodiment of the invention.
Figure 6:
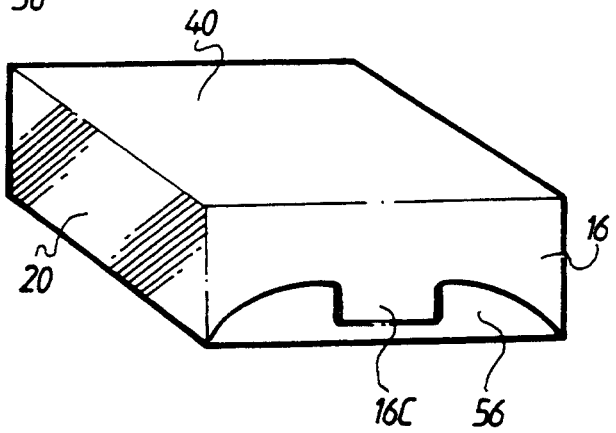
FIG. 6 shows the container of FIG. 5 when closed.
Figure 7:
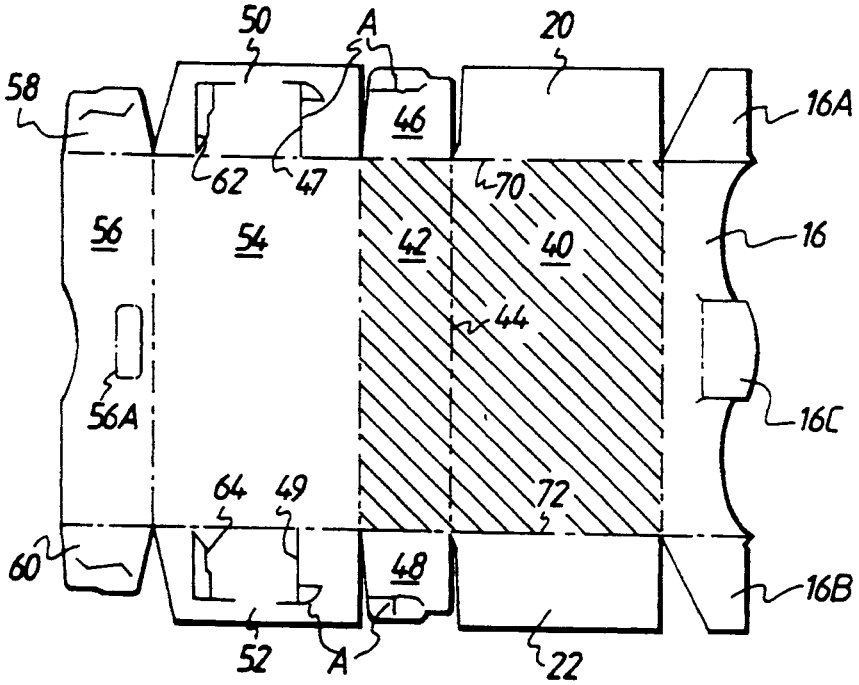
FIG. 7 is a blank erectible into the container shown in FIGS. 5 and 6.

In the arrangement of FIGS. 5, 6 and 7 a modified construction is provided in that the container shown in FIG. 5 is shown in the open condition, and the extended base area is provided by the top base 40 and a rear wall 42 which are hinged together along hinge line 44.

A wall surrounds top 40 and is made up of front panel 16 and side panels 20 and 22.

Attached to the rear wall 42 are lock tabs 46, 48, and these are lockingly engaged in side walls 50, 52 which are hinged to the base panel 54.

Base panel 54 has a front wall 56 which has lock tabs 58, 60 which engage in lock slots 62 and 64 in side walls 50, 52.

When the container is closed as shown in FIG. 6, the top is hinged about hinge line 44 so that the rear wall 42 forming part of the extended base 40, 42 in FIG. 5 lies vertically as shown in FIG. 6 and therefore the actual base area (panel 54) of the closed container is smaller than the extended base area of the container when in the open position because in this position the container is turned through 90° so that the area 4 of panels 40, 42 becomes the base, and these panels as shown by hatched lines, are covered by receptor material. When the container is opened from the FIG. 6 position to the FIG. 5 position and then tilted through 90°, the product can be spread out over the extended base area to enhance microwave cooking.

FIG. 7 illustrates the blank which is erectible into the container shown in FIG. 5, and the erection of same will be understood from FIG. 7 or may be briefly explained as follows.

Panels 50 and 52 are folded upwardly from the FIG. 7 position, as is panel 56. The locking tabs 56, 60 are inserted in slots 62, 64. Panel 44 is folded upwardly, and locking tabs 46 and 48 are folded so as to be inserted in the slots 47, 49 in the sides 50, 52. The product is now placed in the base tray so formed. Panel 40 is folded relative to panel 47 after glue tabs 16A and 16B are folded relative to side panels 20 and 22 so as to lie to the insides of panels 20, 22 to which the tabs 16A, 16B are glued.

When the top 40 and rear 42 are folded about hinge line 44, the tabs 46, 48, sides 50 and 52, and tabs 58, 60 lie within the walls 20, 22 and 16, and to achieve this the hinge lines 70 and 72 are stepped as shown to ensure that to facilitate entry the lock tabs 46, 48, 58, 60 lie to the outside of sides 50, 52 and the side walls 20, 22 cover the sides 50, 52 and the tabs 46, 48, 58, 60 as shown in FIG. 6.

The panel 16 has a tongue 16C which engages in a wide slot 56A in front panel 56 when the container is closed, as shown in FIG. 6.

Figure 8:
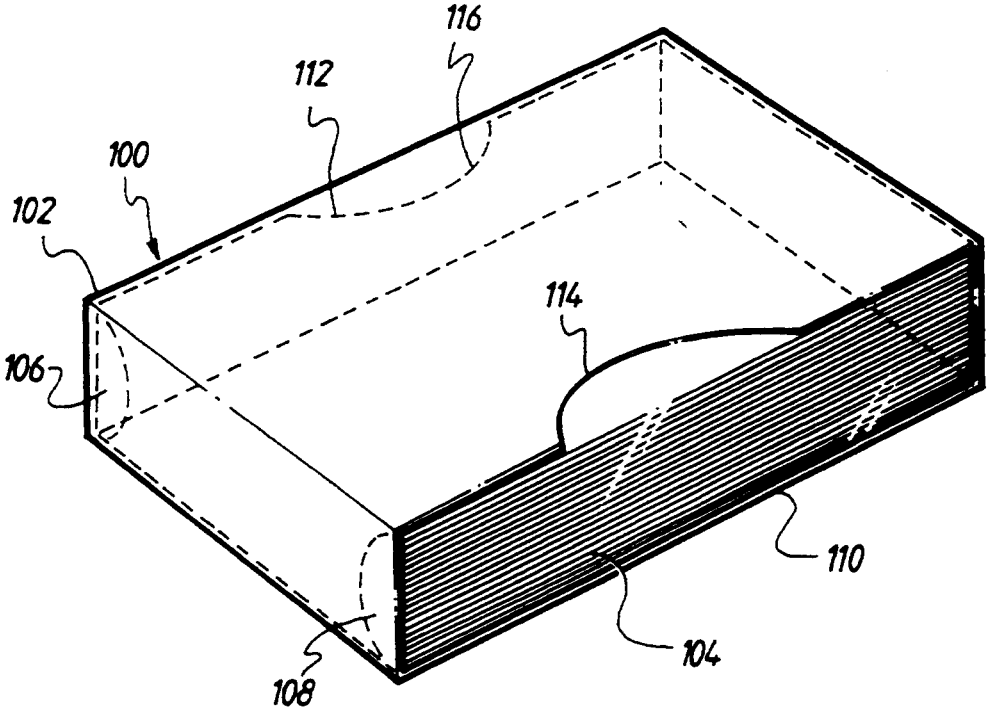
FIG. 8 shows a container according to a further embodiment of the invention.
Figure 9:
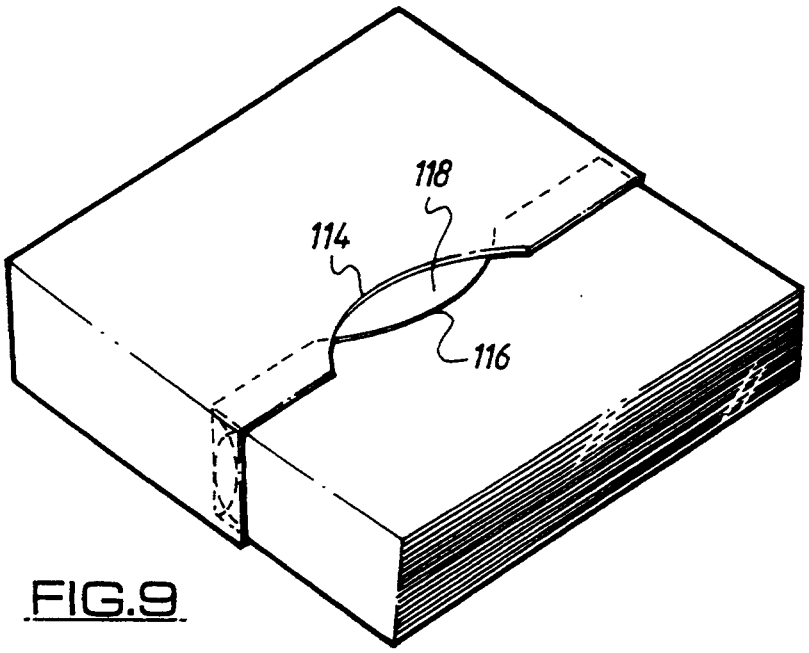
FIG. 9 shows the container of FIG. 8 when in the open position.

In the embodiment of the invention shown in FIGS. 8 and 9, a box container 100 is made up of two interfitting parts 102 and 104. These parts can be slid open to the position shown in FIG. 9, and the extent to which they can be slid apart is limited by catch tabs 106 and 108 on the respective parts.

Each part is open at one side, and thus part 102 is open at the side indicated by reference 110, whilst part 104 is open at the side indicated by reference 112.

At the open side, on the top panel, the part 102 is cut-away as shown at 114, and similarly as shown at 116 the inner part 104 is cut away at the top of the open side.

The product obviously is contained within the container in the condition shown in FIG. 8, but when it is required to cook the product which may for example be chipped potatoes, the container is pulled apart to the position shown in FIG. 9 wherein the cut-away portions 114 and 116 overlap to provide a vent aperture 118, the base surface on which the product stands has been extended (approximately double) and if the product is chipped potatoes, the container in the open position in FIG. 9 can be shaken to distribute the chipped potatoes throughout the extended base region, and the container placed directly in a microwave oven for cooking.

The base of each of the parts 102 and 104 may be provided with receptor material.

The container may embody a sealing means which has to be broken to enable the container to be moved apart in order to prevent tampering, and any suitable blank construction may be adopted for the formation of the respective parts.

An extremely effective microwave cooking container results.

I claim:

1. The combination of a closed packaging container and its foodstuff contents in the form of plural items to be microwave cooked when in the container wherein the packaging container is a box comprising (a) a base tray, said base tray comprising
  i) a base panel on which the plural items stand and including a front edge, a rear edge and side edges;
  ii) a front flange connected to and extending upwardly from said base panel front edge; and
  iii) side flanges connected to and extending upwardly from said base panel side edges respectively;

(b) a top, said top comprising:
  i) a top panel of the same size as the said base panel and having a front edge, a rear edge and side edges;
  ii) a front flange connected to and extending downwardly from said top panel front edge; and
  iii) side flanges connected to and extending downwardly from said top panel side edges respectively, and (c) a rear wall connecting the rear edge of the base panel and the rear edge of the top panel, and wherein in the closed condition of the packaging container the flanges of the top and the base tray overlap, and the rear wall is hinged to said top panel so that to open the container the top is hinged relative to the rear wall to a position in which the rear wall and the top panel lie in the same plane and together define a surface of greater area than the base panel alone and onto which the plural items can be spread out so as to be more spread out for more effective microwave cooking.

2. The combination of a closed packaging container and its foodstuff contents in the form of plural items to be microwave cooked when in the container wherein the packaging container is a box comprising (a) a base tray, said base tray comprising
  i) a base panel on which the plural items stand and including a front edge, a rear edge and side edges;
  ii) a front flange connected to and extending upwardly from said base panel front edge; and
  iii) side flanges connected to and extending upwardly from said base panel side edges respectively;

(b) a top, said top comprising:
  i) a top panel of the same size as the said base panel and having a front edge, a rear edge and side edges;
  ii) a front flange connected to and extending downwardly from said top panel front edge; and
  iii) side flanges connected to and extending downwardly from said top panel side edges respectively, and (c) a rear wall connecting the rear edge of the base panel and the rear edge of the top panel, and wherein in the closed condition of the packaging container the flanges of the top and the base tray overlap, and the rear wall is hinged to said base panel so that to open the container the top and rear wall are hinged relative to the base panel to a position in which the rear wall and the base panel lie in the same plane and together define a surface of greater area than the base panel alone and the plural items can be opened out so as to spread out over said surface for more effective microwave cooking.

3. The combination of a closed packaging container and its foodstuff contents in the form of plural items to be microwave cooked when in the container wherein the packaging container is a box comprising (a) a base tray, said base tray comprising
  i) a base panel on which the plural items stand and including a front edge, a rear edge and side edges;
  ii) a front flange connected to and extending upwardly from said base panel front edge; and
  iii) side flanges connected to and extending upwardly from said base panel side edges respectively;

(b) a top, said top comprising:
  i) a top panel of the same size as the said base panel and having a front edge, a rear edge and side edges;
  ii) a front flange connected to and extending downwardly from said top panel front edge; and
  iii) side flanges connected to and extending downwardly from said top panel side edges respectively, (c) a rear wall connecting the rear edge of the base panel and the rear edge of the top panel; and (d) a panel of microwave susceptor material covering the inner surfaces of the top panel and the rear wall, and wherein in the closed condition of the packaging container the flanges of the top and the base tray overlap, and the rear wall is hinged to said top panel so that to open the container the top is hinged relative to the rear wall to a position in which the rear wall and the top panel lie in the same plane and together define a surface which is covered by said microwave susceptor material and is of greater area than the base panel alone and onto which the plural items can be opened out so as to be more spread out for more effective microwave cooking.

4. The combination of a closed packaging container and its foodstuff contents in the form of plural items to be microwave cooked when in the container wherein the packaging container is a box comprising (a) a base tray, said base tray comprising
  i) a base panel on which the loose items stand and including a front edge, a rear edge and side edges;
  ii) a front flange connected to and extending upwardly from said base panel front edge; and
  iii) side flanges connected to and extending upwardly from said base panel side edges respectively;

(b) a top, said top comprising:
  i) a top panel of the same size as the said base panel and having a front edge, a rear edge and side edges;
  ii) a front flange connected to and extending downwardly from said top panel front edge; and
  iii) side flanges connected to and extending downwardly from said top panel side edges respectively, (c) a rear wall connecting the rear edge of the base panel and the rear edge of the top panel; and (d) a panel of microwave susceptor material covering the inner surfaces of the bottom panel and the rear wall, and wherein in the closed condition of the packaging container the flanges of the top and the base tray overlap, and the rear wall is hinged to said base panel so that to open the container the top and rear wall are hinged relative to the base panel to a position in which the rear wall and the base panel lie in the same plane and together define a surface which is covered by said microwave susceptor material and is of greater area than the base panel alone and the plural items can be spread out so as to be spread out over said surface for more effective microwave cooking.

5. The combination of a closed packaging container and its foodstuff contents in the form of spreadable foodstuff to be microwave cooked when in the container wherein the packaging container is a box comprising (a) a base tray, said base tray comprising
  i) a base panel on which the spreadable foodstuff stands and including a front edge, a rear edge and side edges;
  ii) a front flange connected to and extending upwardly from said base panel front edge; and
  iii) side flanges connected to and extending upwardly from said base panel side edges respectively;

(b) a top, said top comprising:
  i) a top panel of the same size as the said base panel and having a front edge, a rear edge and side edges;
  ii) a front flange connected to and extending downwardly from said top panel front edge; and
  iii) side flanges connected to and extending downwardly from said top panel side edges respectively;

(c) a rear wall connecting the rear edge of the base panel and the rear edge of the top panel; and (d) a panel of microwave susceptor material covering the inner surfaces of the bottom panel and the rear wall, and wherein in the closed condition of the packaging container the flanges of the top and the base tray overlap, and the rear wall is hinged to said base panel so that to open the container the top and rear wall are hinged relative to the base panel to a position in which the rear wall and the base panel lie in the same plane and together define a surface which is covered by said microwave susceptor material and is of greater area than the base panel alone and onto which the spreadable foodstuff can be spread out over the susceptor material for more effective microwave cooking.

6. The combination of a closed packaging container and its contents in the form of plural items to be microwave cooked when in the container wherein the packaging container is a box comprising (a) a first box shell comprising
  i) a rear edge panel;
  ii) side edge panel;
  iii) top and bottom panels;
  iv) an open front edge; and
  v) catch means; and (b) a second box shell slidably located inside the first box shell and comprising
  i) a front edge panel adjacent the open front edge of the first box shell;
  ii) side edge panels adjacent the side edge panels of the first box shell;
  iii) top and bottom panels adjacent the top and bottom panels of the first box shell;
  iv) an open rear edge adjacent the rear edge of the first box shell; and
  v) second box shell catch means said second box shell being adapted to be pulled out of the first box shell until the first box shell catch means engages the second box shell catch means to define a limited open position in which the bottom panels of both shells combine to form an extended surface over which the plural items can be spread by shaking the box.

7. The combination according to claim 6, wherein each of the first box shell bottom panel and the second box shell bottom panel is covered on its inside with microwave susceptor material.

8. The combination according to claim 6 or 7, including a cut out in the top panel of the first box shell adjacent the open front edge and a cut out in the top panel of the second box shell adjacent the open rear edge, said cut outs registering to define a ventilation aperture when the box is in said open position.

* * * * *